United States Patent [19]

Nicholson et al.

[11] Patent Number: 4,888,569

[45] Date of Patent: Dec. 19, 1989

[54] MAGNETICALLY TUNEABLE MILLIMETER WAVE BANDPASS FILTER HAVING HIGH OFF RESONANCE ISOLATION

[75] Inventors: Dean B. Nicholson; Robert J. Matreci, both of Santa Rosa, Calif.

[73] Assignee: Hewlett-Packard Company, Palo Alto, Calif.

[21] Appl. No.: 197,556

[22] Filed: May 23, 1988

[51] Int. Cl.[4] ..... H01P 1/207; H01P 1/217

[52] U.S. Cl. ..... 333/209; 333/202; 333/208; 333/219.2; 333/24.2

[58] Field of Search ..... 333/202, 205–212, 333/24.1, 24.2, 34, 248, 102, 219, 235, 219.2

[56] References Cited

U.S. PATENT DOCUMENTS 3,268,838 8/1966 Matthaei ..... 333/205

*Primary Examiner*—Eugene R. LaRoche
*Assistant Examiner*—Seung Ham
*Attorney, Agent, or Firm*—William C. Milks, III

[57] ABSTRACT

By combining four hexagonal ferrite spheres under the same electromagnet structure, a magnetically tuneable bandpass filter can be built in waveguide yielding high off resonance isolation, while keeping insertion loss to a reasonable value. Implementations of this filter in A, Q, U, and V bands have typical off resonance isolation greater than 70 dB and insertion loss less than 13 dB for full-band tuning. The filter can be utilized as a preselector for swept-frequency signal analyzers, for example.

24 Claims, 16 Drawing Sheets

WAVEGUIDE FILLED WITH REXOLITE

MAGNETICALLY TUNEABLE MILLIMETER WAVE BANDPASS FILTER HAVING HIGH OFF RESONANCE ISOLATION

BACKGROUND OF THE INVENTION

This invention relates to circuits for filtering electrical signals and, more particularly, to magnetically tuneable circuits for filtering high frequency electromagnetic signals propagating in a waveguide. Specifically, the invention in one embodiment is directed to magnetically tuneable, four-ferrite-sphere waveguide bandpass filters having high off resonance isolation.

Generally, bandpass filters transmit electrical signals within a given frequency range and reject electrical signals having frequencies which lie outside the given frequency range. One known type of bandpass filter is a variable frequency bandpass filter whose frequency passband is altered by controlling the reactance of the circuit parameters of the filter. Such variable frequency bandpass filters are utilized, for example, as preselectors for swept-frequency signal analyzers, such as the HP 8566B or 8562A signal analyzer or the HP 71300A modular measurement system available from Hewlett-Packard Company, Signal Analysis Division, Rohnert Park, California.

One type of variable frequency bandpass filter is the magnetically tuneable filter. In this filter, the frequency passband is varied by controlling the current to an electromagnet which tunes variable frequency resonator elements in the filter across different frequency ranges. Known variable frequency resonator elements include hexagonal ferrite spheres and yttrium-iron-garnet (YIG) spheres.

The advantage of utilizing hexagonal ferrite spheres, instead of YIG spheres, for magnetically tuneable filters in the millimeter wave region is that they have a large internal anisotropy field ($H_a$), which reduces the applied magnetic field needed to achieve resonance ($f_{res}$=2.8 MHz/oersted ($H_a+H_{applied}$)). By reducing the required magnetic field, problems associated with electromagnet heating, hysteresis, tuning linearity, and maximum tuning frequency can be reduced.

Iris-coupled, two-sphere, magnetically tuneable millimeter wave bandpass filters fabricated in a waveguide (FIG. 1) utilizing hexagonal ferrite spheres are known. See, for example, Matthaei, G., Young, L., and Jones, E.M.T., "Microwave Filters, Impedance-Matching Networks, and Coupling Structures," Artech House, 1980, pp. 1040–1085; Sweschenikow, J. A., Merinow, E. K., and Pollak, B. P., "Bandfilter aus Hexaferriten im Mikrowellenbereich," Nachrichtechnik Elektronik, 26, 1976, pp. 262–264; and Nicholson, D., "A High Performance Hexagonal Ferrite Tuneable Bandpass Filter for the 40–60 GHz Region," 1985 IEEE MTT-S International Microwave Symposium Digest, pp. 229–232. These filters have been demonstrated to filter across full waveguide bandwidths up through W band, as shown in FIGS. 2, 3, and 4.

The extension of the iris-coupled, two-ferrite-sphere waveguide bandpass filter utilizing one electromagnet to a three- or four-sphere structure having increased off resonance isolation has not, however, been satisfactorily achieved. The aforementioned Sweschenikow, et al., article discloses a three-sphere waveguide bandpass filter utilizing hexagonal ferrite spheres (FIG. 5). The addition of the third sphere did not increase the insertion loss significantly, but only improved the off resonance isolation by approximately 12 dB, while unfortunately spreading the electromagnet pole tips farther apart. In contrast, Fjerstad, R. L., "Some Design Considerations and Realizations of Iris-Coupled YIG-Tuned Filters in the 12–40 GHz Region," IEEE Trans. on Microwave Theory and Techniques, Vol. MMT-8, No. 4, April, 1970, pp. 205–212, discloses a four-sphere waveguide bandpass filter utilizing YIG spheres (FIG. 6). However, this four-YIG-sphere waveguide bandpass filter has a limited bandwidth and poor off resonance isolation at high frequencies. A broadband millimeter wave bandpass filter having high off resonance isolation preferably utilizing hexagonal ferrite spheres is, therefore, needed.

SUMMARY OF THE INVENTION

One embodiment of the present invention provides a magnetically tuneable four-sphere bandpass filter preferably utilizing hexagonal ferrite spheres in a waveguide, without increasing the separation of electromagnet pole tips, that has high off resonance isolation. The invention provides in one embodiment a magnetically tuneable bandpass filter comprising four ferrite spheres as resonators and further preferably comprising $TE_{10}$ rectangular waveguide as an input waveguide, output waveguide, and transfer waveguide. The four spheres are configured as a pair of two-sphere filters. Preferably, the pair of two-sphere filters comprises a first sphere in the input waveguide placed directly over a first iris below which is positioned a second sphere in the transfer waveguide in an over-under configuration and a third sphere in the output waveguide placed directly over a second iris below which is situated a fourth sphere in the transfer waveguide in another over-under configuration. The pair of two-sphere filters is connected by the transfer waveguide, thereby allowing all four spheres to be situated under the area of the surface of one electromagnet pole tip. All spheres preferably have waveguide shorts directly behind them in the waveguides in which they reside.

This approach differs from the approach disclosed in the aforementioned Fjerstad article where a four-YIG-sphere bandpass filter was constructed in a single waveguide with axial irises, instead of a plural waveguide structure including a transfer waveguide and over-under sphere configurations as provided by one embodiment of the invention. The use of the over-under configuration of the spheres provides tighter coupling between them compared to the side-to-side coupling reported previously for the four-YIG-sphere waveguide bandpass filter. This decreases insertion loss and increases bandwidth.

The magnetically tuneable, four-ferrite-sphere waveguide bandpass filter in accordance with one embodiment of the invention achieves similar performance to two cascaded two-sphere filters without requiring two separate electromagnets. The bandpass filter of the invention exhibits full-band performance in A band (26.5–40 GHz), Q band (33–50 GHz), U band (40–60 GHz), and V band (50–75 GHz). A series of four-sphere magnetically tuneable bandpass filters fabricated in a waveguide utilizing hexagonal ferrite spheres as tuning elements in accordance with one embodiment of the invention, operated in A, Q, U, and V bands, has typical off resonance isolation greater than 70 dB and insertion loss less than 13 dB.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings. In the drawings:

FIG. 1, comprising

FIG. 6, comprising

FIG. 7, comprising

FIG. 8, comprising

FIG. 11, comprising

FIG. 13, comprising

FIG. 17, comprising FIG. 18, comprising

DETAILED DESCRIPTION OF THE PREFERRED EMBODIMENTS

Figure 7A:
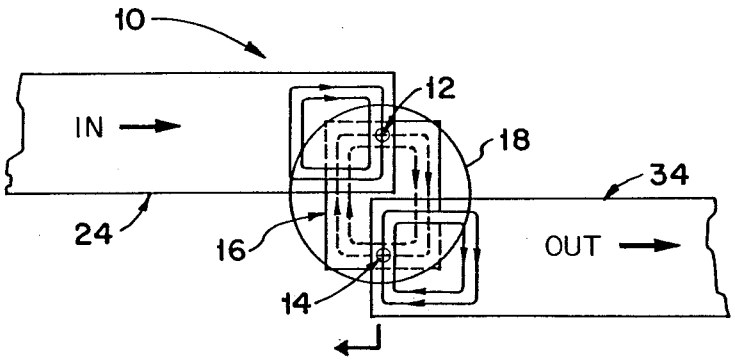
FIGS. 7A and 7B, is a schematic drawing of a magnetically tuneable four-sphere waveguide bandpass filter in accordance with one embodiment of the invention in plan (FIG. 7A) and in cross-section (FIG. 7B)

A schematic drawing of one embodiment of a four-sphere waveguide bandpass filter in accordance with the invention, generally indicated by the numeral 10, is shown in FIG. 7. The waveguide bandpass filter 10 comprises a pair of two-sphere waveguide bandpass filters, including a first two-sphere waveguide bandpass filter 12 and a second two-sphere waveguide bandpass filter 14, connected by a transfer waveguide 16. This allows all four spheres to fit under one electromagnet pole tip 18. Another electromagnet having a pole tip 20 is preferably included for increasing the applied magnetic field.

Figure 7B:
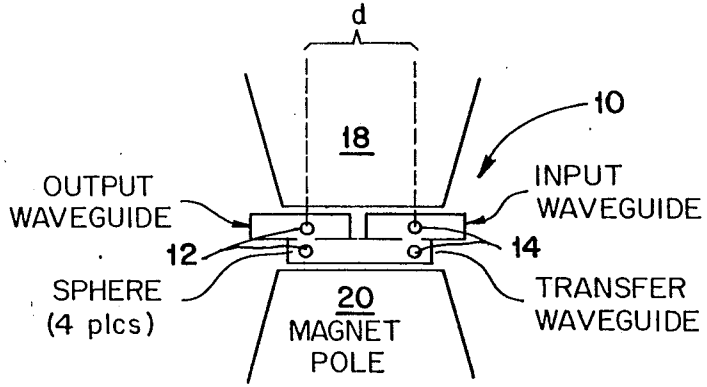
Figure 8C:
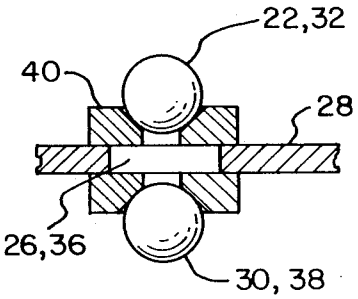
FIGS. 8A, 8B, and 8C, is an exploded view of one implementation of the four-sphere waveguide bandpass filter shown in FIG. 7.
Figure 8B:
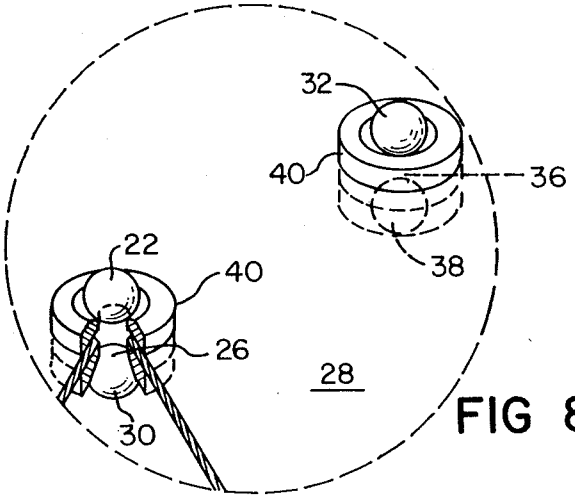
Figure 8A:
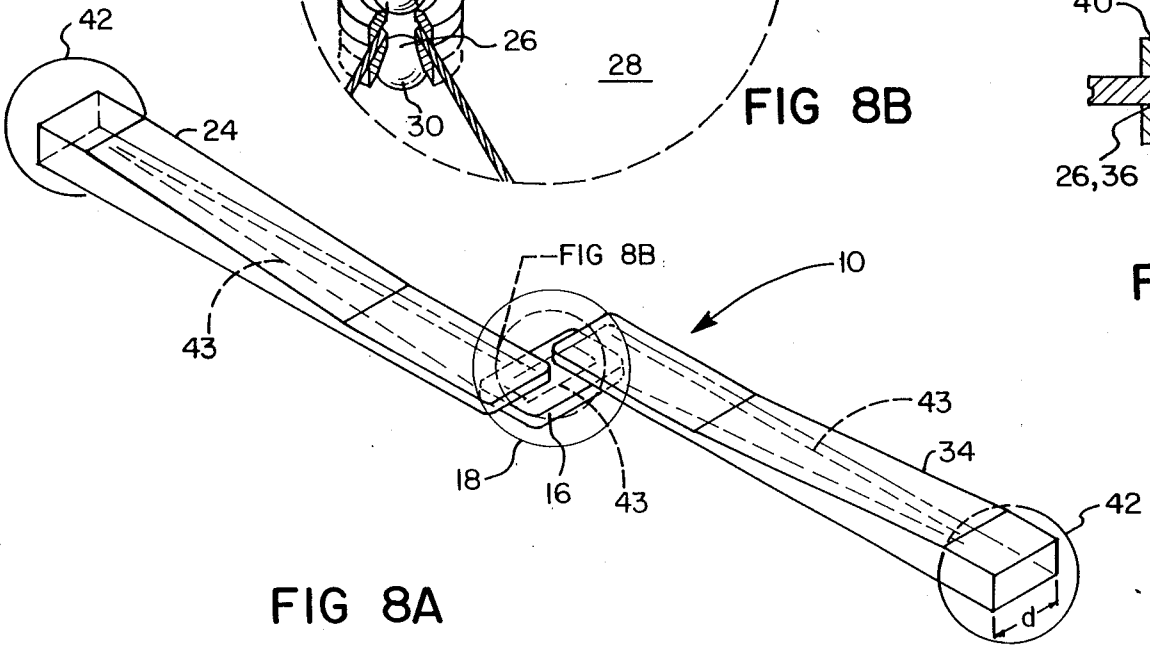

As shown in FIGS. 7 and 8, the first two-sphere filter 12 comprises a first sphere 22 in an input waveguide 24. The first sphere 22 is placed directly over a first iris 26 in an iris plate 28 below which is positioned a second sphere 30 in the transfer waveguide 16 in an over-under configuration. The second two-sphere filter 14 comprises a third sphere 32 in an output waveguide 34. The third sphere 32 is placed directly over a second iris 36 in the iris plate 28 below which is situated a fourth sphere 38 in the transfer waveguide 16 in another over-under configuration. Accordingly, the input waveguide 24 and the output waveguide 34 overlie the transfer waveguide 16. The pair of two-sphere filters 12 and 14 is connected by the transfer waveguide 16, thereby allowing all four of the spheres 22, 30, 32, and 38 to be situated under the area of the surface of one electromagnet pole tip 18 or between the electromagnetic pole tips 18 and 20. The spheres 22, 30, 32, and 38 preferably have waveguide shorts directly behind them in the waveguides in which they reside to increase the magnetic coupling of the energy in the input, output, and transfer waveguides 24, 34, and 16 to the spheres.

As shown in FIG. 8, the spheres 22, 30, 32, and 38 are preferably mounted on annular dielectric holders 40 preferably glued circumferentially around the irises 26 and 36. Alternatively, the spheres 22, 30, 32, and 38 can be mounted on dielectric rods (not shown) which are movable to allow adjustment of sphere position and rotation with respect to the irises 26 and 36. Also, any combination of the above-described mounting arrangements can be employed.

The spacing d of the two sets of spheres 22, 30 and 32, 38 from each other is approximately one waveguide width, which becomes a small distance in the millimeter wave region. This allows compact electromagnets to be utilized. The size of the spheres 22, 30, 32, and 38 in relation to the waveguide width and height and the sphere-to-sphere separation (top to bottom) are set so as to give a maximally flat filter response to avoid ripples in the frequency passband. The spheres 22, 30, 32, and 38 preferably consist of barium ferrite crystals.

The input waveguide 24 and the output waveguide 34 are both preferably perpendicular to the transfer waveguide 16. The input waveguide 24 and the output waveguide 34 are kept at 90° angles to the transfer waveguide 16 to create magnetic field mode mismatches to increase off resonance isolation.

The input, output, and transfer waveguides 24, 34, and 16 are all preferably reduced in height between the electromagnet pole tips 18 and 20, as shown in FIGS. 7B and 8. This reduces the current required for tuning. The input waveguide 24 and the output waveguide 34 preferably have a linear taper to transition from reduced height under the electromagnet pole tips 18 and 20 to standard height waveguide at connecting flanges 42.

Dielectric loading can be introduced into the input, output, and transfer waveguides 24, 34, and 16 by the incorporation of dielectric material 43, such as Rexolite, as shown in dotted lines in FIG. 8. The advantage is that this allows utilization of narrower waveguides and thus a smaller diameter electromagnet for a given frequency range. As will be described in more detail later, this shifts the frequency passband. A typical dimension for the dielectric material 43 in a 33–50 GHz waveguide bandpass filter 10 to shift it to a 26.5–40 GHz waveguide bandpass filter can be, for example, 0.025-inch high by 0.100-inch wide Rexolite.

In operation, at the resonant frequency of the spheres 22, 30, 32, and 38, energy is taken from the input waveguide 24 and coupled into the first sphere 22 in the input waveguide and is then coupled through the first iris 26 under the sphere 22 to the second sphere 30 directly below it in the transfer waveguide 16, which reradiates the energy down the transfer waveguide. The energy reradiated down the transfer waveguide 16 is coupled into the fourth sphere 38 in the transfer waveguide and is then coupled through the second iris 36 to the third sphere 32 directly above it in the output waveguide 34. The third sphere 32 in the output waveguide 34 reradiates the energy, which then travels down the output waveguide. Off the resonant frequency of the spheres 22, 30, 32, and 38, the small diameter of the irises 26 and 36 substantially prevents energy from coupling from the input waveguide 24 to the output waveguide 34.

Based on a comparison of the four-sphere waveguide bandpass filter 10 to two cascaded two-sphere filters, the off resonance isolation is expected to be double (in dB) the value for a pair of cascaded two-sphere filters. The insertion loss of the four-sphere waveguide bandpass filter 10 is also expected to be about double (in dB) the amount for a pair of cascaded two-sphere filters. Advantageously, however, by eliminating one set of input and output transitions present in a pair of cascaded two-sphere filters, the insertion loss is expected to be .5–1 dB less than a simple doubling.

Figure 5:
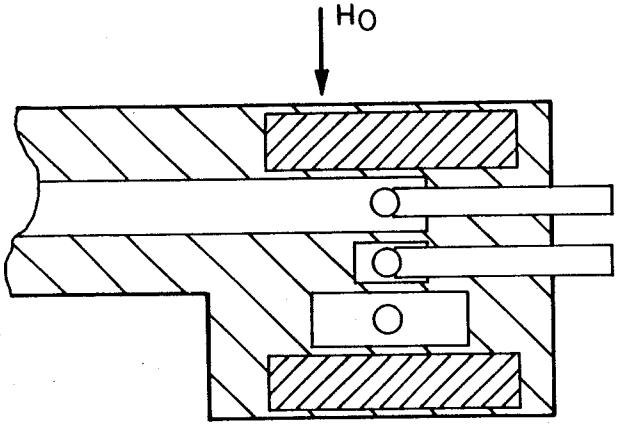
FIG 5 (PRIOR ART)
FIG. 5 is a cross-sectional schematic drawing of a known configuration for a magnetically tuneable three-sphere waveguide bandpass filter.
Figure 1A:
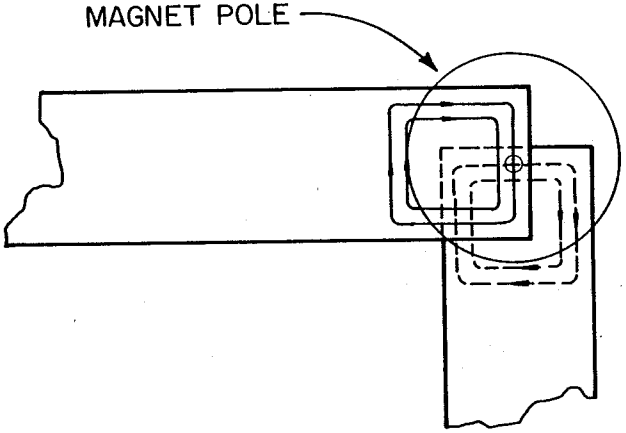
FIG 1A (PRIOR ART)
FIGS. 1A and 1B, is a schematic drawing of a known configuration for a magnetically tuneable two-sphere waveguide bandpass filter in plan (FIG. 1A) and in cross-section (FIG. 1B)
Figure 1B:
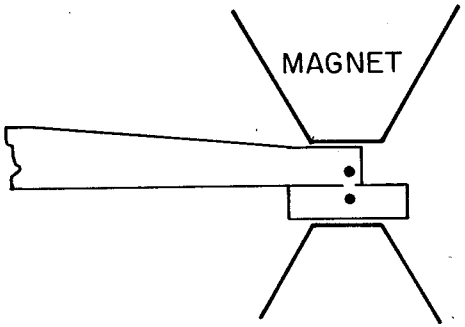
FIG 1B (PRIOR ART)
Figure 2:
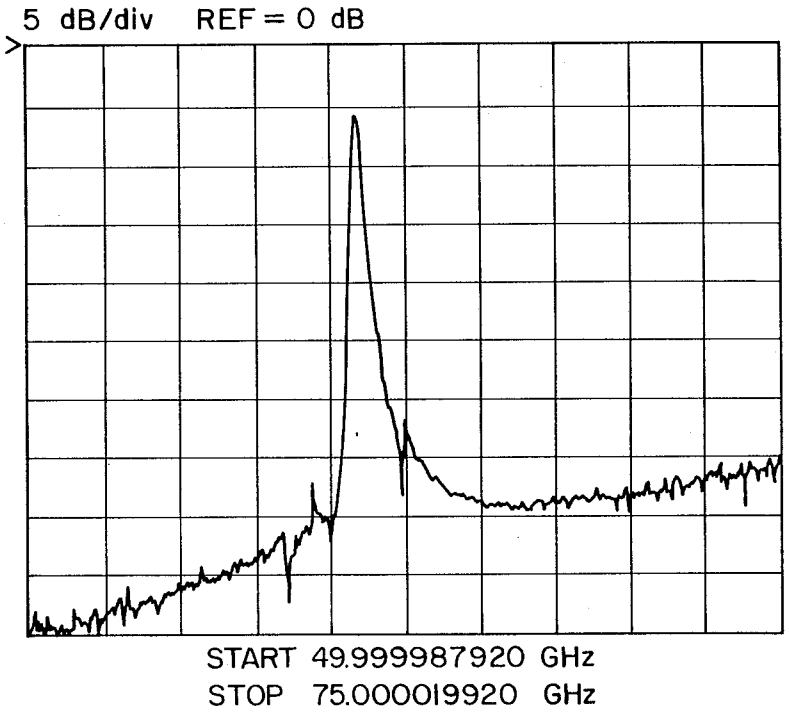
FIG 2 (PRIOR ART)
FIG. 2 illustrates a typical response characteristic for the two-sphere waveguide bandpass filter shown in FIG. 1.
Figure 3:
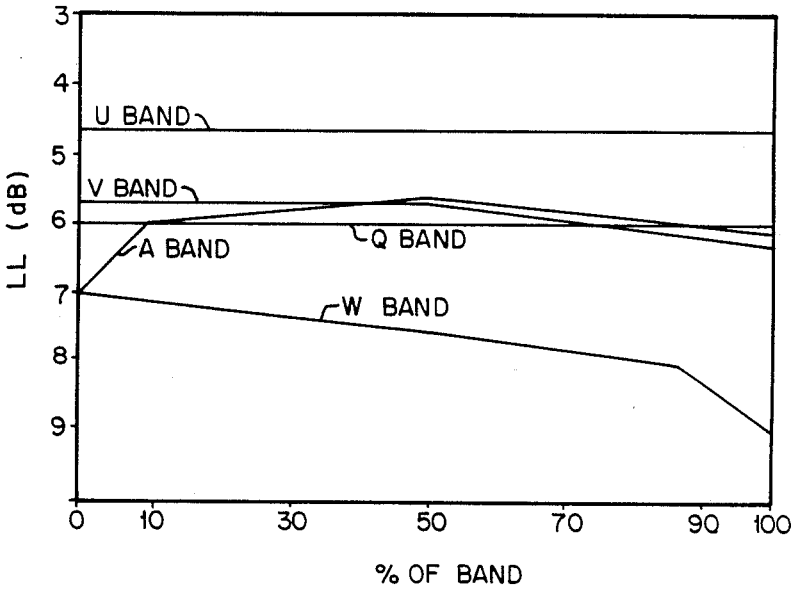
FIG 3 (PRIOR ART)
FIG. 3 is a plot of insertion loss versus percent of frequency band for the two-sphere waveguide bandpass filter shown in FIG. 1.
Figure 4:
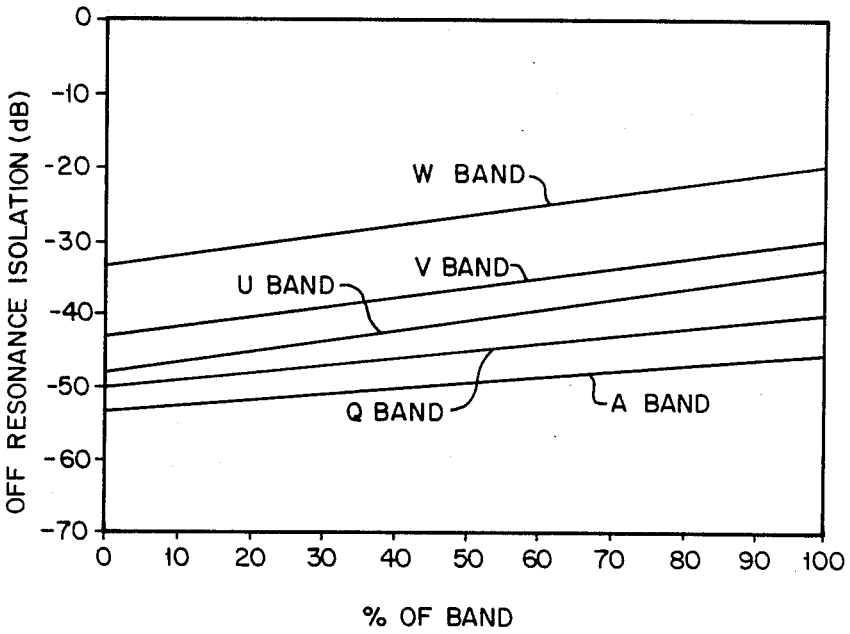
FIG 4 (PRIOR ART)
FIG. 4 is a plot of off resonance isolation versus percent of frequency band for the two-sphere waveguide bandpass filter shown in FIG. 1.
Figure 6A:
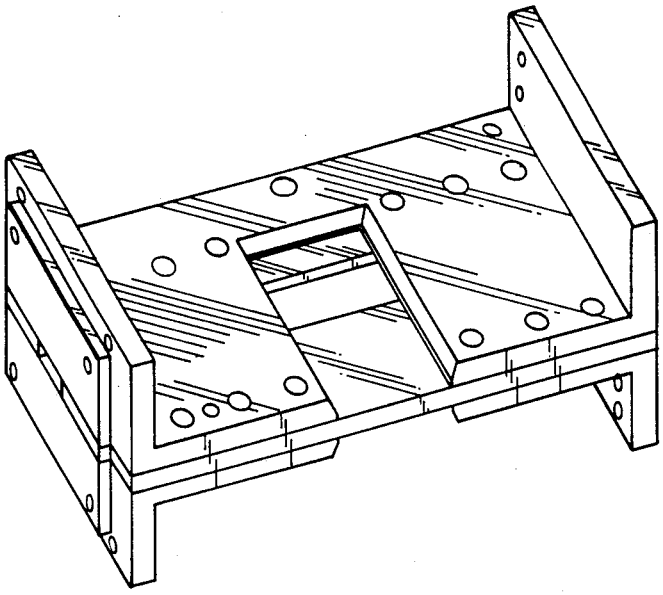
FIG 6A (PRIOR ART)
FIGS. 6A and 6B, is a schematic drawing of a known configuration for a magnetically tuneable four-YIG-sphere waveguide bandpass filter in plan (FIG. 6A) and in cross-section (FIG. 6B)
Figure 6B:
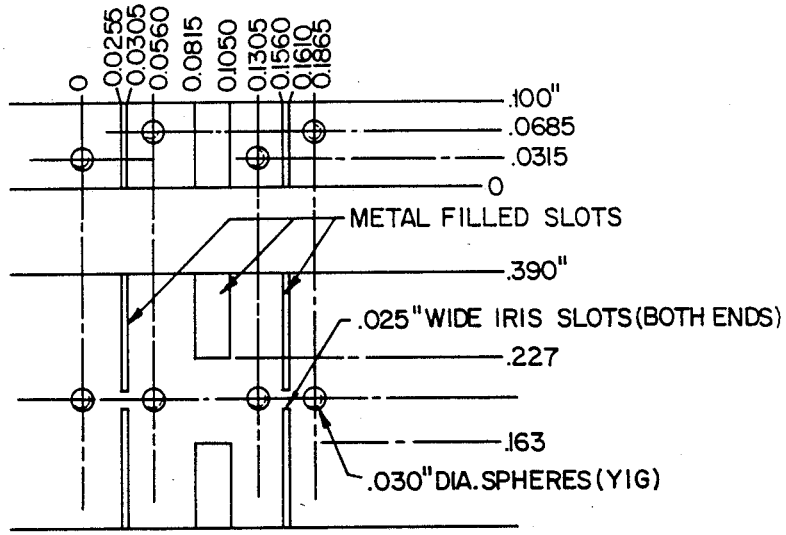
FIG 6B (PRIOR ART)
Figure 9:
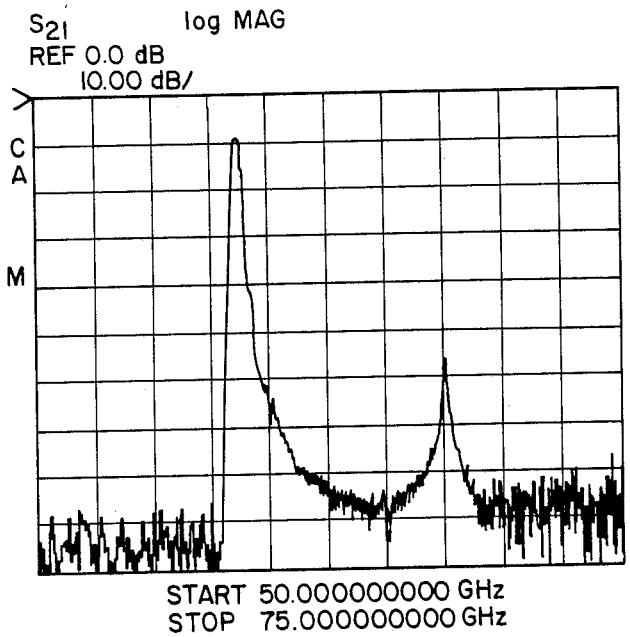
FIG. 9 illustrates a typical response characteristic for the four-sphere waveguide bandpass filter shown in FIG. 7.

A four-ferrite-sphere, magnetically tuneable waveguide bandpass filter 10 in accordance with one embodiment of the invention was implemented with WR-15 waveguide and utilizing doped $BaFe_{12}O_{19}$ spheres for the variable frequency resonator elements and tested in the 50–75 GHz region. Insertion loss results for the entire region and typical off resonance isolation results demonstrate that the expected performance was achieved. FIG. 9 illustrates a typical four-ferrite-sphere waveguide bandpass filter 10 response in V band. It can be seen that the insertion loss is slightly less than twice that (in dB) expected of a pair of cascaded two-sphere V band filters (FIGS. 2 and 3). The off resonance isolation is about twice (in dB) that of a pair of cascaded two-sphere V band filters. The results produced by the filters are similar for the A, Q, and U bands.

Utilizing a transfer waveguide 16 to connect the pair of two-sphere filters 12 and 14 allows the entire four-sphere waveguide bandpass filter 10 to be placed under one electromagnet pole tip 18, thereby decreasing the energy needed to tune the filter by one-half compared to a pair of cascaded two-sphere filters each with its own electromagnet and connected by a longer length of waveguide. By utilizing a four-sphere waveguide bandpass filter 10, which has two irises 26 and 36 to reJect out-of-band energy, instead of a two-sphere filter with only one iris, the out-of-band rejection of energy is greatly increased, thereby leading to better performance in preselectors for swept-frequency signal analyzers and other uses.

Figure 10:
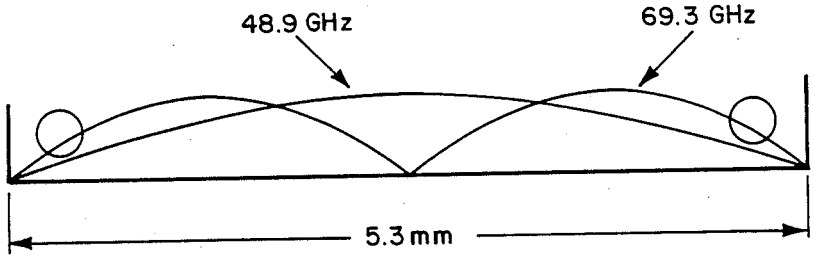
FIG. 10 is a diagram which shows transfer waveguide resonances for the four-sphere waveguide bandpass filter shown in FIG. 7.

Referring again to FIG. 7, the transfer waveguide 16 with a backshort at both ends forms a waveguide resonator. At the cavity resonant frequency, energy can be coupled to an undesirable extent from the input waveguide 24 to the output waveguide 34 through the irises 26 and 36. Cavity resonances in the transfer waveguide 16 are shown for V band in FIG. 10. Calculations indicated that a $\lambda g/2$ mode would occur at 48.9 GHz and a $\lambda g$ mode at 69.3 GHz. At these frequencies, the length of the transfer waveguide 16 acts as a bandpass filter, degrading the off resonance isolation.

As shown in FIG. 9, the $\lambda g$ cavity mode which was expected to appear at 69.3 GHz actually appears at 67.5 GHz due to dielectric loading effects at the spheres 22, 30, 32, and 38. The typical $\lambda g/2$ mode is below the bottom of the band (50 GHz) as expected.

This cavity resonance can be de-Q'd and suppressed by introducing a small amount of lossy dielectric material which has the same loss in both directions. Also, the cavity can be de-Q'd by introducing a high resistivity metal plating on the transfer waveguide 16 or composite material, such as polyiron, in the cavity itself. Alternatively, by introducing loss only in the reverse direction with an appropriately placed resonance isolator material, the cavity can be de-Q'd with negligible increase in filter insertion loss. See, for example, Taft, D. R., Harrison, G. R., Hodges, Jr., L. R., "Millimeter Resonance Isolators Utilizing Hexagonal Ferrites," IEEE Trans. on Microwave Theory and Techniques, Vol. MTT-11, No. 5, September, 1963, pp. 346–350, the disclosure of which is hereby incorporated by reference in its entirety.

Figure 11A:
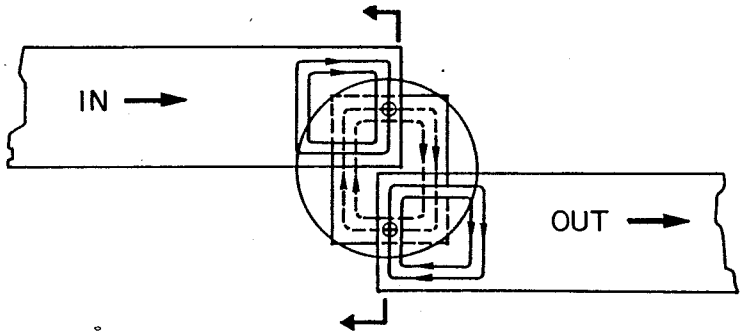
FIGS. 11A and 11B, is a schematic drawing in plan (FIG. 11A) and in cross-section (FIG. 11B) of a magnetically tuneable four-sphere waveguide bandpass filter shown in FIG. 7 modified to additionally comprise lossy dielectric material in the transfer waveguide.
Figure 11B:
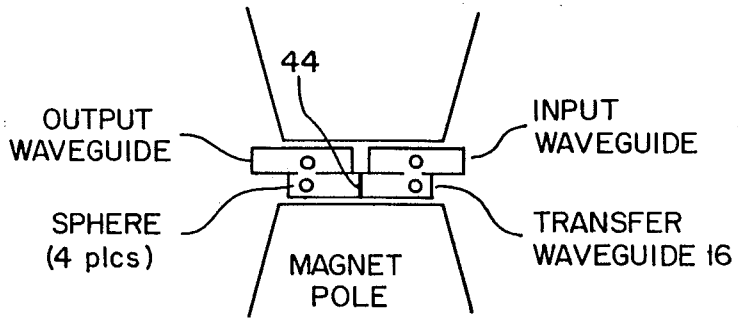
Figure 12:
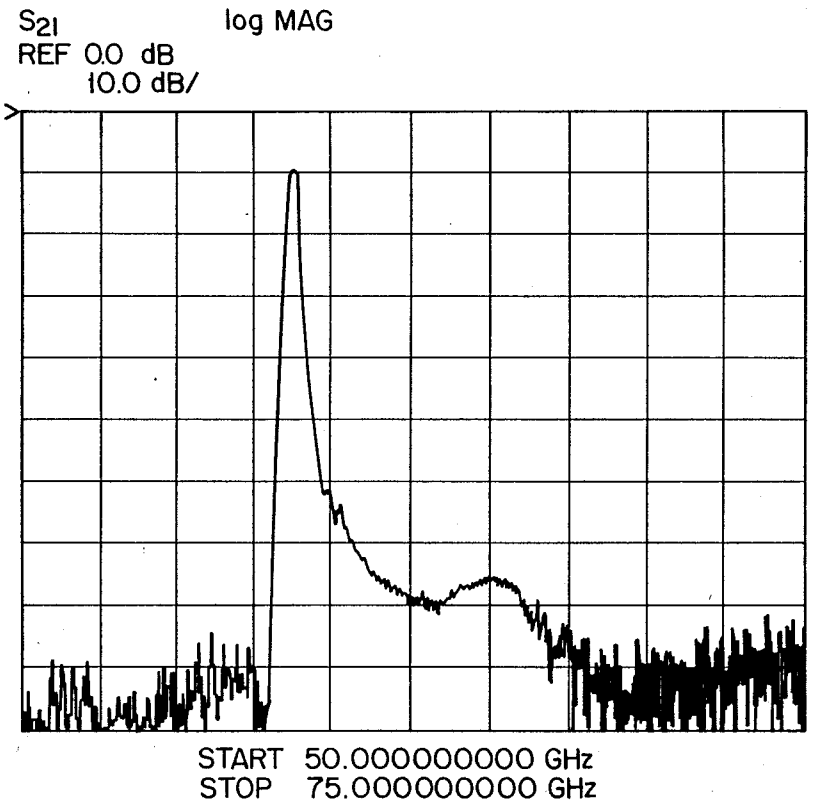
FIG. 12 illustrates a typical response characteristic for the four-sphere waveguide bandpass filter shown in FIG. 11.
Figure 13C:
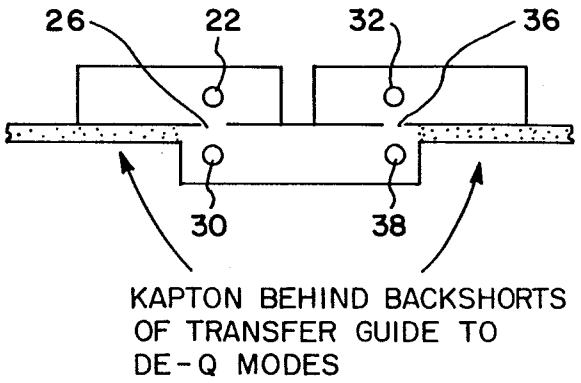
FIGS. 13A, 13B, and 13C, is a schematic drawing in plan (FIG. 13A) and in cross-section (FIG. 13B) of a modified magnetically tuneable four-sphere waveguide bandpass filter similar to that shown in FIG. 7 but having offset spheres and a shortened transfer waveguide to suppress cavity resonances, as well as a schematic drawing in cross-section (FIG. 13C) having dielectric material added behind backshorts of the transfer waveguide.

Preferably, the excess feedthrough caused by the $\lambda g$ resonance is greatly decreased by introducing a small amount of lossy dielectric material in the transfer waveguide 16. As shown in FIG. 11, this loss can be introduced either by an attenuating vane 44 in the transfer waveguide 16 or by placing a thin (approximately 50$\mu$) sheet of dielectric, such as Kapton, at the backshorts in the transfer waveguide, as shown in FIG. 13C. As shown in FIG. 12, introduction of 1–2 dB of loss in the transfer waveguide 16 yields about 15–20 dB of attenuation in the cavity mode induced feedthrough.

Use of a reciprocally lossy material in the transfer waveguide 16 to suppress the cavity resonance induced feedthrough from the input to the output decreases off resonance feedthrough at the cavity resonance frequency, while introducing only a small increase in frequency passband insertion loss. Alternatively, use of loss in only the reverse direction in the cavity of the transfer waveguide 16 produces a very large decrease in the cavity resonance induced feedthrough with only a negligible increase in passband insertion loss.

In addition to the typical cavity modes which can occur many GHz away from the frequency passband, there are also λg/2 and λg modes which are perturbed by the large permeability (both positive and negative), which occurs near resonance, and tend to follow within a few hundred MHz of the frequency passband as it is tuned. With no loss introduced in the transfer waveguide 16, these perturbed cavity modes can produce ripples in the frequency passband. With the introduction of loss or an appropriately placed resonance isolator material, these irregularities are greatly reduced. If the degradation in off resonance isolation due to the typical λg cavity mode is, however, unacceptable, even after it has been reduced by 15–20 dB with the introduction of loss in the transfer waveguide 16, for example, it can be eliminated completely by the following technique.

Figure 13A:
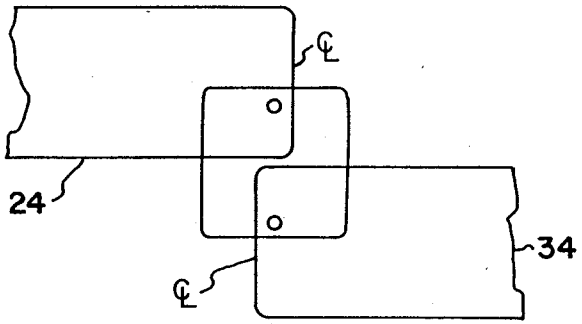
Figure 13B:
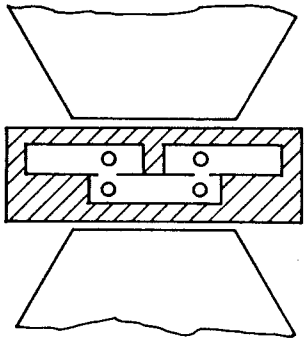
Figure 14:
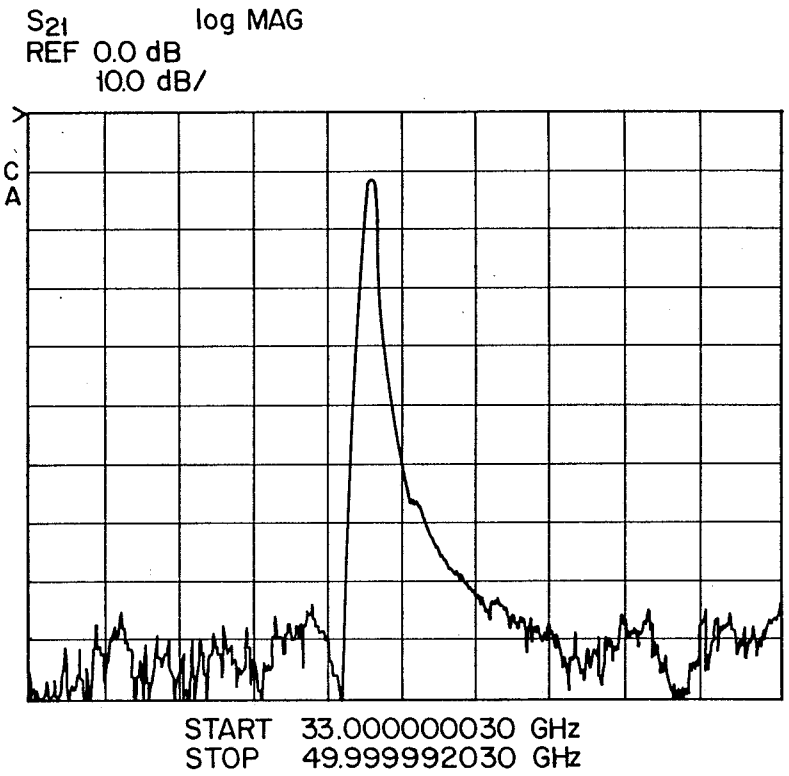
FIG. 14 illustrates a typical response characteristic for the four-sphere waveguide bandpass filter shown in FIG. 13 which exhibits elimination of typical cavity modes.

As shown in FIG. 13, by offsetting the spheres 22, 30, 32, and 38 from the center of the input waveguide 24 and output waveguide 34 so that they are slightly closer to each other, the transfer waveguide 16 can be shortened enough to push the λg mode out the top of the band. Shortening the transfer waveguide 16 brings the λg/2 mode in near the bottom of the band, but it's frequency can be reduced below band again by placing a piece of dielectric material midway between the spheres 30 and 38 in the transfer waveguide. The point midway between the spheres 30 and 38 in the transfer waveguide 16 is an E field null for the λg mode, so that it's frequency is not affected, and both typical modes are now out of band. An example of this technique is shown in a Q band filter response in FIG. 14. In the case of a shortened transfer waveguide 16 with off-center spheres 22, 30, 32, and 38, the introduction of dielectric material (not shown), such as Rexolite, into the input, output, and transfer waveguides 24, 34, and 16, including proper placement slightly off center in the input and output waveguides, can keep the magnetic fields over the irises 26 and 36 parallel to backshorts for good off resonance isolation in short transfer waveguide bandpass filters.

A performance summary for the four-sphere waveguide bandpass filter 10 in accordance with the invention is given below in Table I showing the similar performance obtained in the different bands. All results are for filters with loss introduced in the transfer waveguide 16 for cavity mode suppression. The four-sphere filter parameters are as follows.

TABLE I

| Band (GHz) | Insertion Loss (dB) Minimum | Insertion Loss (dB) Maximum | O.R.I. (Typical) | 3 dB Bandwidth (MHz) Minimum | 3 dB Bandwidth (MHz) Maximum | Electromagnet Power (WATTS) Minimum | Electromagnet Power (WATTS) Maximum |
|---|---|---|---|---|---|---|---|
| A (26.5–40) | 11.0 | 14.0 | >75 dB | 120 | 200 | .27 | 4.7 |
| Q (33–50) | 10.0 | 13.0 | >75 dB | 180 | 260 | .28 | 7.1 |
| U (40–60) | 8.0 | 12.0 | >75 dB | 180 | 270 | .28 | 8.4 |
| V (50–75) | 8.0 | 12.0 | >70 dB | 190 | 300 | .35 | 12.0 |

Figure 15:
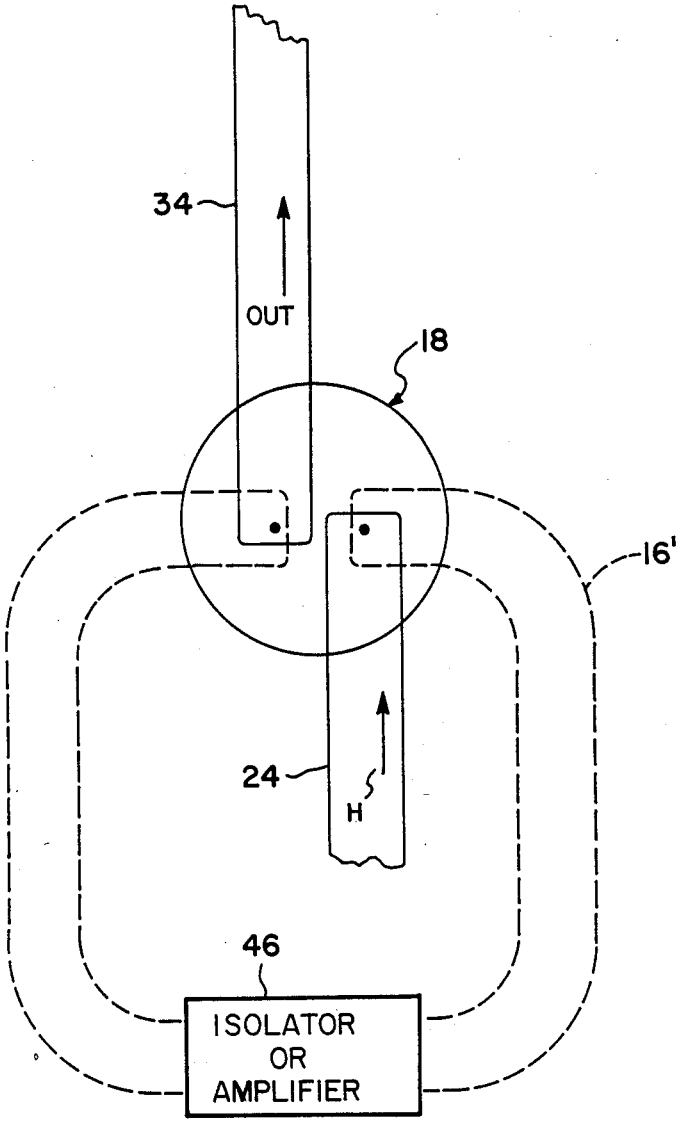
FIG. 15 is a schematic drawing in plan of a magnetically tuneable four-sphere waveguide bandpass filter having an external isolator in accordance with another embodiment of the invention.

As shown in FIG. 15, the pair of the two-sphere filters 12 and 14 under one electromagnet pole tip 18 is provided with a transfer waveguide 16' external to the electromagnet as a connection between the filters. The advantages are that with an external waveguide connection between the pair of two-sphere filters 12 and 14, a commercially available full-band isolator 46 can be utilized to completely suppress the transfer waveguide resonances. This configuration is advantageous when any cavity mode perturbation on the frequency passband is undesirable or the addition of dielectric material or loss to a short transfer waveguide 16 sufficient to suppress modes to the desired extent becomes prohibitive in terms of insertion loss. Alternatively, an amplifier can be inserted between the filters 12 and 14 to cancel out the loss of the second filter 14, as well as to provide isolation between the two filters.

Figure 16:
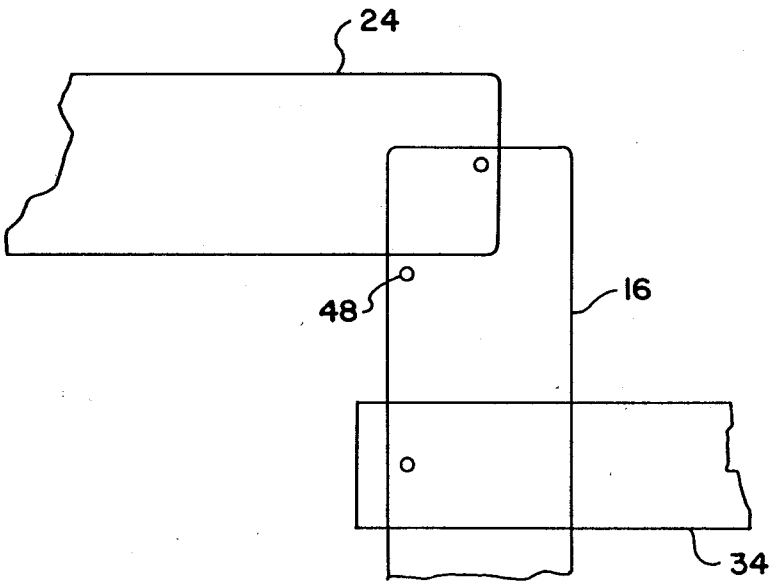
FIG. 16 is a schematic drawing in plan of an integrated bandstop filter in a bandpass filter in accordance with a further embodiment of the invention.

FIG. 16 shows an extra sphere 48 or spheres positioned relative to the backshort of at least one of the input, output, and transfer waveguides 24, 34, and 16, for example, in the transfer waveguide, so that they act as bandstop filters integrated into the four-sphere waveguide bandpass filter 10. Hexagonal ferrite spheres can have greatly different resonant frequencies, and a sphere or spheres can be advantageously selected that resonate at a frequency offset, in relation to the spheres 22, 30, 32, and 38, corresponding to that frequency at which an extra large attenuation is desired. This allows filter skirts and general off resonance isolation to be tailored in ways that would otherwise be physically cumbersome (extra electromagnet required) or impossible.

Figure 17A:
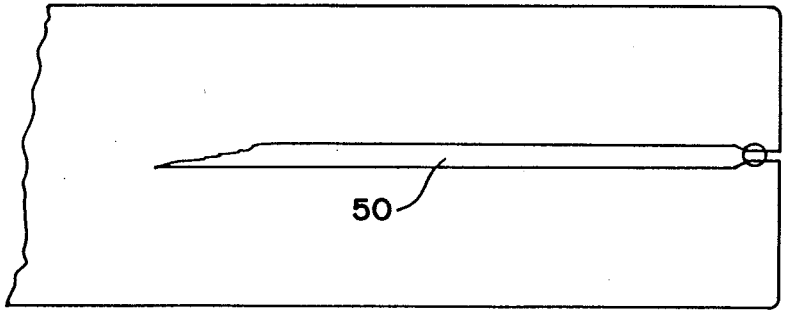
FIGS. 17A and 17B, is a schematic drawing of a magnetically tuneable four-sphere ridge waveguide bandpass filter in plan (FIG. 17A) and cross-section (FIG. 17B) in accordance with an additional embodiment of the invention.
Figure 17B:
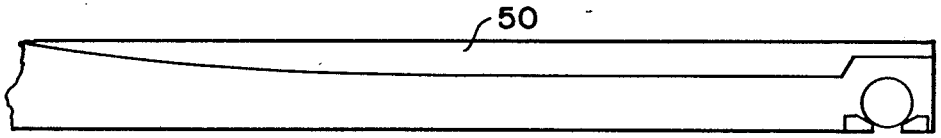
Figure 18A:
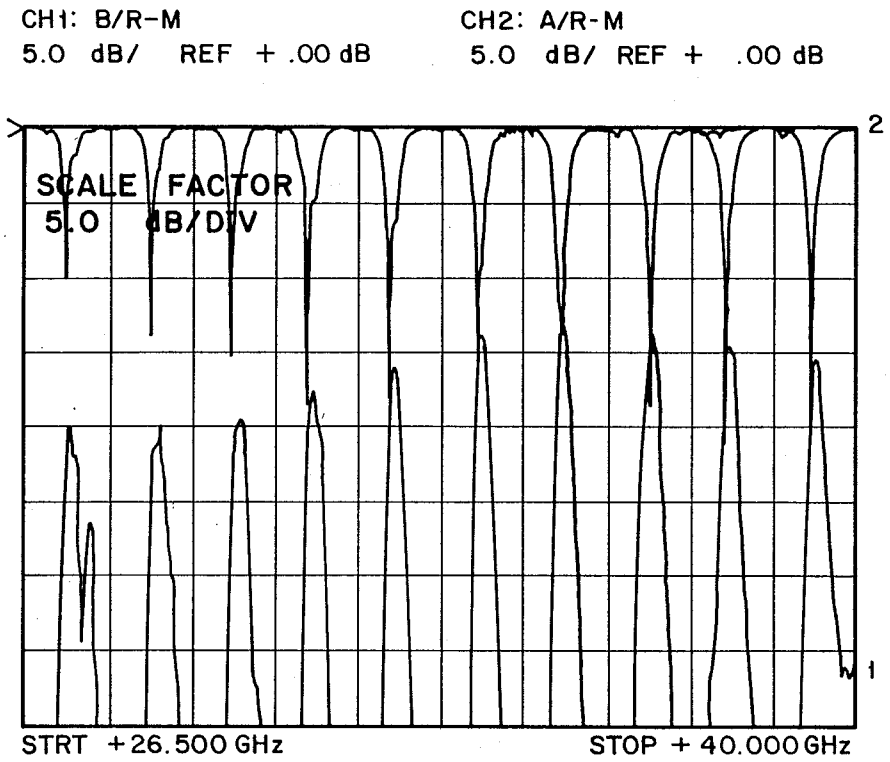
FIGS. 18A and 18B, illustrates a typical response characteristic for the four-sphere waveguide bandpass filter shown in FIG. 7 (FIG. 18A) and the four-sphere ridge waveguide bandpass filter shown in FIG. 17 (FIG. 18B) which exhibits a decrease in insertion loss.
Figure 18B:
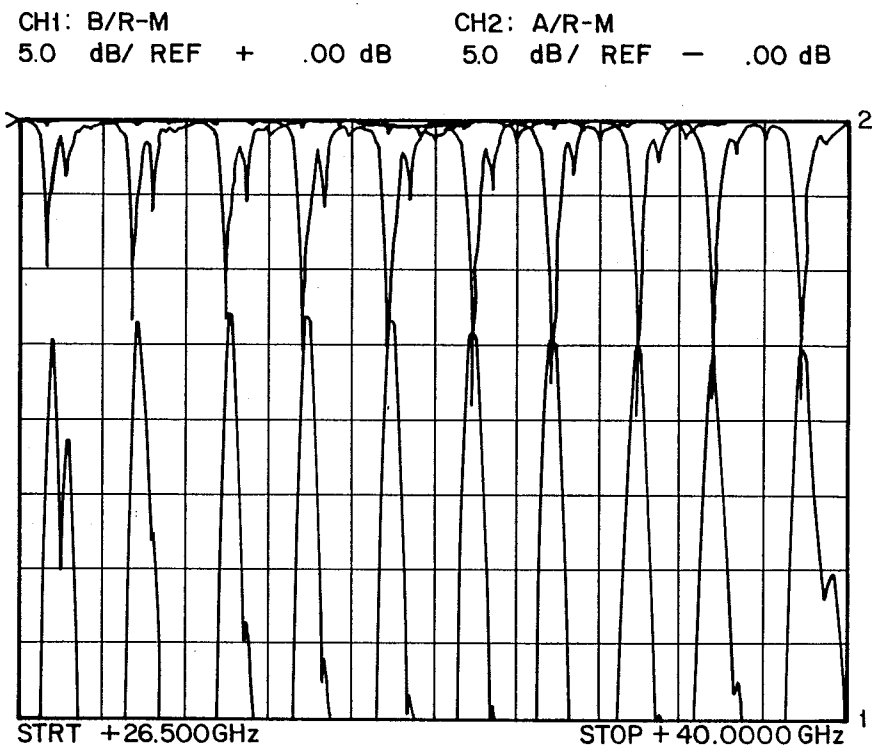

Finally, as shown in FIG. 17, a ridge waveguide having ridges 50 positioned over the spheres 22, 30, 32, and 38 in the input, output, and transfer waveguides 24, 34, and 16 increases magnetic field coupling. The advantages are that by increasing the magnetic field coupling from the input, output, and transfer waveguides 24, 34, and 16 to the spheres 22, 30, 32, and 38, insertion loss is decreased in a waveguide bandpass filter, as shown in FIG. 18, and the bandwidth in waveguide bandpass and bandstop filters is broadened.

The foregoing description is offered primarily for purposes of illustration. While a variety of embodiments has been disclosed, it will be readily apparent to those skilled in the art that numerous other modifications and variations not mentioned above can still be made without departing from the spirit and scope of the invention as claimed below.

What is claimed is:

1. A four-sphere magnetically tuneable integrated waveguide bandpass filter comprising:

an input waveguide having a first axis;

an output waveguide having a second axis longitudinally offset from the first axis;

the input waveguide and the output waveguide being connected by a transfer waveguide, the transfer waveguide having a third axis non-parallel to at least one of the first and second axes;

a first two-sphere waveguide bandpass filter comprising a first variable frequency resonator sphere in the input waveguide placed directly over a first iris below which is positioned a second variable frequency resonator sphere in the transfer waveguide in an over-under configuration; and a second two-sphere waveguide bandpass filter comprising a third variable frequency resonator sphere in the output waveguide placed directly over a second iris below which is situated a fourth variable frequency resonator sphere in the transfer waveguide in another over-under configuration;

the pair of two-sphere filters being connected by the transfer waveguide;

thereby allowing all four spheres to be situated under the area of the surface of at least one electromagnet pole tip.

2. The waveguide bandpass filter of claim 1 wherein the input, output, and transfer waveguides have a given waveguide width and wherein the lateral spacing of the first and second spheres from the third and fourth spheres is about one waveguide width, thereby allowing a compact electromagnet to be utilized, and the size of the spheres in relation to the waveguide and the sphere-to-sphere separation is set so as to give a maximally flat filter response to avoid ripples in the frequency passband.

3. The waveguide bandpass filter of claim 1 wherein the spheres consist of barium ferrite crystals.

4. The waveguide bandpass filter of claim 1 wherein the input waveguide and the output waveguide are both at 90° angles to the transfer waveguide to create magnetic field mode mismatches to increase off resonance isolation.

5. The waveguide bandpass filter of claim 1 wherein the input waveguide and the transfer waveguide have a given waveguide height beyond the electromagnet pole tip and wherein the input, output, and transfer waveguides are all reduced in height beneath the electromagnet pole tip to reduce the current required for tuning.

6. The waveguide bandpass filter of claim 5 wherein the input waveguide and the output waveguide have a linear taper to transition from reduced height under the electromagnet pole tip to the given waveguide height at connecting flanges.

7. The waveguide bandpass filter of claim 1, further comprising another electromagnet having a pole tip for increasing the applied magnetic field.

8. The waveguide bandpass filter of claim 1 wherein the spheres are mounted on annular dielectric holders glued circumferentially around the irises.

9. The waveguide bandpass filter of claim 1 wherein the waveguides are $TE_{10}$ waveguides.

10. The waveguide bandpass filter of claim 1 wherein the input waveguide and the output waveguide have a cross-sectional width dimension and a cross-sectional height dimension and wherein the first and second spheres are substantially centered along the longer cross-sectional dimension of the input waveguide and wherein the third and fourth spheres are substantially centered along the longer cross-sectional dimension of the output waveguide, further comprising lossy dielectric material situated in the transfer waveguide to attenuate a $\frac{1}{2}$ λg cavity mode.

11. The waveguide bandpass filter of claim 1 wherein the input waveguide and the output waveguide have a cross-sectional width dimension and a cross-sectional height dimension and wherein the first and second spheres are substantially centered along the longer cross-sectional dimension of the input waveguide and wherein the third and fourth spheres are substantially centered along the longer cross-sectional dimension of the output waveguide, further comprising lossy dielectric material situated in the transfer waveguide to attenuate a λg cavity mode.

12. The waveguide bandpass filter of claim 1 wherein the input waveguide and the output waveguide have a cross-sectional width dimension and a cross-sectional height dimension and wherein the first and second spheres are offset along the longer cross-sectional dimension of the input waveguide and wherein the third and fourth spheres are offset along the longer cross-sectional dimension of the output waveguide towards each other and wherein the transfer waveguide is shortened, further comprising means situated substantially in the center of the transfer waveguide for dielectric loading to effectively move a $\frac{1}{2}$ λg cavity mode out of band.

13. The waveguide bandpass filter of claim 1 wherein the input waveguide and the output waveguide have a cross-sectional width dimension and a cross-sectional height dimension and wherein the first and second spheres are offset along the longer cross-sectional dimension of the input waveguide and wherein the third and fourth spheres are offset along the longer cross-sectional dimension of the output waveguide towards each other and wherein the transfer waveguide is shortened to effectively move a λg cavity mode out of band.

14. The waveguide bandpass filter of claim 1 wherein the input waveguide and the output waveguide have a cross-sectional width dimension and a cross-sectional height dimension and wherein the first and second spheres are offset along the longer cross-sectional dimension of the input waveguide and wherein the third and fourth spheres are offset along the longer cross-sectional dimension of the output waveguide towards each other and wherein the transfer waveguide is shortened, thereby producing a $\frac{1}{2}$ λg cavity mode in the waveguide band, further comprising means situated substantially in the center of the transfer waveguide for dielectric loading to effectively move the $\frac{1}{2}$ λg cavity mode towards the lower end of the waveguide band and lossy dielectric material situated in the transfer waveguide to attenuate the $\frac{1}{2}$ λg cavity mode.

15. The waveguide bandpass filter of claim 1 wherein the input waveguide and the output waveguide have a cross-sectional width dimension and a cross-sectional height dimension and wherein the first and second spheres are substantially centered along the longer cross-sectional dimension of the input waveguide and wherein the third and fourth spheres are substantially centered along the longer cross-sectional dimension of the output waveguide, further comprising isolator means situated in the transfer waveguide to suppress a $\frac{1}{2}$ λg cavity mode.

16. The waveguide bandpass filter of claim 1 wherein the input waveguide and the output waveguide have a cross-sectional width dimension and a cross-sectional height dimension and wherein the first and second spheres are substantially centered along the longer cross-sectional dimension of the input waveguide and wherein the third and fourth spheres are substantially centered along the longer cross-sectional dimension of the output waveguide, further comprising isolator means situated in the transfer waveguide to suppress a λg cavity mode.

17. The waveguide bandpass filter of claim 9, further comprising a ridge waveguide positioned over the spheres in the $TE_{10}$ waveguide to increase magnetic field coupling from the waveguides to the spheres.

18. The waveguide bandpass filter of claim 1, further comprising at least one additional sphere situated in the transfer waveguide positioned relative to a backshort in the transfer waveguide so that the at least one additional sphere acts as a bandstop filter integrated into the bandpass filter.

19. The waveguide bandpass filter of claim 1, further comprising at least one additional sphere situated in the input waveguide positioned relative to a backshort in the input waveguide so that the at least one additional sphere acts as a bandstop filter integrated into the bandpass filter.

20. The waveguide bandpass filter of claim 1, further comprising at least one additional sphere situated in the output waveguide positioned relative to a backshort in the output waveguide so that the at least one additional sphere acts as a bandstop filter integrated into the bandpass filter.

21. The waveguide bandpass filter of claim 1 wherein the transfer waveguide provides a coupling between the first and second spheres, on the one hand, and the third and fourth spheres, on the other hand, external to the electromagnet, and further comprising isolator means situated in the transfer waveguide to suppress cavity modes.

22. The waveguide bandpass filter of claim 1 wherein the transfer waveguide provides a coupling between the first and second spheres, on the one hand, and the third and fourth spheres, on the other hand, external to the electromagnet, and further comprising an amplifier situated in the transfer waveguide to suppress cavity modes.

23. The waveguide bandpass filter of claim 1, further comprising dielectric material contiguous to a backshort and adjacent the cavity at least one end of the transfer waveguide to attenuate cavity modes.

24. The bandpass filter of claim 1, further comprising dielectric loading disposed in at least one of the input, output, and transfer waveguides to allow utilization of narrower waveguide and thus a smaller electromagnet for a given frequency range.

* * * * *